US006475280B2

(12) United States Patent
Burgess et al.

(10) Patent No.: US 6,475,280 B2
(45) Date of Patent: Nov. 5, 2002

(54) COATING MACHINE FOR APPLYING AND DRYING PHOTOSENSITIVE EMULSION ON A PLASTIC FILM

(75) Inventors: Dennis M. Burgess, Minnetonka Beach; William J. Campbell, Minnetonka, both of MN (US)

(73) Assignee: Burgess Industries Inc., Plymouth, MN (US)

( * ) Notice: Subject to any disclaimer, the term of this patent is extended or adjusted under 35 U.S.C. 154(b) by 81 days.

(21) Appl. No.: 09/772,026

(22) Filed: Jan. 29, 2001

(65) Prior Publication Data

US 2001/0045185 A1 Nov. 29, 2001

Related U.S. Application Data

(60) Provisional application No. 60/200,406, filed on Apr. 28, 2000.

(51) Int. Cl.[7] ..... B05C 1/02

(52) U.S. Cl. ..... 118/66; 118/108; 118/208; 118/236; 118/256

(58) Field of Search ..... 118/58, 66, 108, 118/207, 208, 236, 256; 427/356, 358, 378

(56) References Cited

U.S. PATENT DOCUMENTS

| | | | |
|---|---|---|---|
| 2,385,599 | A | 9/1945 | Ball |
| 3,593,641 | A | 7/1971 | Adams |
| 4,258,125 | A | 3/1981 | Edhlund |
| 5,383,968 | A | 1/1995 | Rantanen |
| 5,595,601 | A | 1/1997 | Lintula |
| 5,856,061 | A | 1/1999 | Patel |

OTHER PUBLICATIONS

Coating Machine By Dupont Company In Wilmington, DE.
Coating Machine By AP2 Company, Chicago, IL.

*Primary Examiner*—Laura Edwards
(74) *Attorney, Agent, or Firm*—James V. Harmon

(57) ABSTRACT

An emulsion coater is provided with a framework having a table or work surface for supporting a sheet of material that is to be coated e.g., a sheet of transparent plastic film. A carriage is mounted on the framework for rectilinear movement thereacross parallel to the surface of the sheet to advance a coating applicator across the sheet. A coating dryer is also mounted on the carriage to progressively dry the coating from one end to the other as it is applied. A motor is supported on the framework for moving the carriage forwardly from one end of the sheet to the other. Provision is made for disengaging the coating applicator from the carriage once the coating has been applied and thereafter moving the carriage in a reverse direction across the applied coating to the starting position while optionally continuing to dry the coating. In order to remove drippings and spills, a sheet of paper is unwound from a supply roll supported at one end of the framework, advanced across the work surface and rewound at the opposite end of the supporting framework. A washing pan that can be filled with water is provided at one end of the machine for removing coating material from the applicator before it has a chance to dry.

18 Claims, 4 Drawing Sheets

COATING MACHINE FOR APPLYING AND DRYING PHOTOSENSITIVE EMULSION ON A PLASTIC FILM

This application claims the benefit of provisional application No. 60/200,406 filed Apr. 28, 2000.

FIELD OF THE INVENTION

This invention relates to color printing equipment and more particularly to equipment for applying a photosensitive emulsion to a backing sheet and simultaneously drying the emulsion.

BACKGROUND OF THE INVENTION

In the printing industry, a proof of a color print is often required prior to setting up the printing press. In order to provide a proof, several photosensitive films, each comprising a color separation positive, are laminated together to produce the finished proof which is then examined prior to setting up the printing press. Typical colors are black, cyan, magenta and yellow, but one or more additional colored sheets may be required particularly if the customer needs to print a special or unusual color. To do this, a specially coated sheet may be required. The present invention is particularly well adapted to preparing photosensitive coated sheets used in proofing color printing.

To effectively apply such a coating and provide the required coating quality and uniformity i.e., to maintain the required coating thickness and to assure a smooth surface as well as to achieve the required hardness when the sheet is ready to be removed from the coater, the coating must be dried under controlled conditions. Such conditions are difficult or impossible to achieve with available equipment. The applied coating must be dry to the touch shortly after being coated and before the sheet is removed from the coater, usually less than five minutes from the time the coating is applied. In developing the present invention, it was discovered that it is advantageous to continuously and progressively dry the coating as the coating is being applied. It was discovered that doing so would stabilize the coating while maintaining a smooth surface so that the sheet can be handled almost immediately after the coating is applied.

Another shortcoming of previous equipment is that there has previously been no way to apply a coating in a given feed direction e.g., from left to right and subsequently dry the applied coating in a reverse direction from right to left. To make this possible it was necessary to find a way to spread the coating evenly in the first pass and then make a second pass without the coating applicator in place which, if present, would damage the applied coating as it was carried back across the coated material.

Another problem is caused by the coating material that clings to the coating applicator and must be removed before it has hardened. An additional deficiency of prior equipment is the lack of an easy way of washing the coating applicator once the coating has been applied.

In view of these and other deficiencies of the prior art it is one object of the invention to provide an improved emulsion coater for effectively applying and simultaneously drying a photosensitive photographic coating onto a backing sheet.

Another objective of the invention is to find a way to dry an emulsion coating material in an area that is just behind the leading edge of the freshly applied coating while it is being applied.

Yet another object in the invention is the provision of the improved coating apparatus for progressively coating a backing sheet in a given feed direction with a provision for automatically disconnecting and removing the coating applicator once the backing has been completely coated so that it can be picked up manually and washed.

Another object is to find a way of applying an emulsion progressively across a backing sheet and thereafter drying the applied coating without the requirement of an oven next to the coater for receiving the freshly coated sheet.

Yet another object of the present invention is to provide an improved coating applicator having a simple but effective provision for quickly and easily removing spilled coating material from the work surface.

These and other more detailed and specific objects of the present invention will be better understood by reference to the following figures and detailed description which illustrate by way of example but a few of the various forms of the invention within the scope of the appended claims.

THE FIGURES

SUMMARY OF THE INVENTION

An emulsion coater is provided with a framework having a table or work surface for supporting a sheet of material that is to be coated e.g., a sheet of transparent plastic film. A carriage is mounted on the framework for rectilinear movement thereacross parallel to the surface of the sheet to advance a coating applicator across the sheet. A coating dryer is also mounted on the carriage to progressively dry the coating from one end to the other as it is applied. A motor is supported on the framework for moving the carriage forwardly from one end of the sheet to the other. Provision is made for disengaging the coating applicator from the carriage once the coating has been applied and thereafter moving the carriage in a reverse direction across the applied coating to the starting position while optionally continuing to dry the coating. In order to remove drippings and spills, a sheet of paper is unwound from a supply roll supported at one end of the framework, advanced across the work surface and rewound at the opposite end of the supporting framework. A washing pan that can be filled with water is provided at one end of the machine for removing coating material from the applicator before it has a chance to dry.

DETAILED DESCRIPTION OF THE INVENTION

Figure 1:
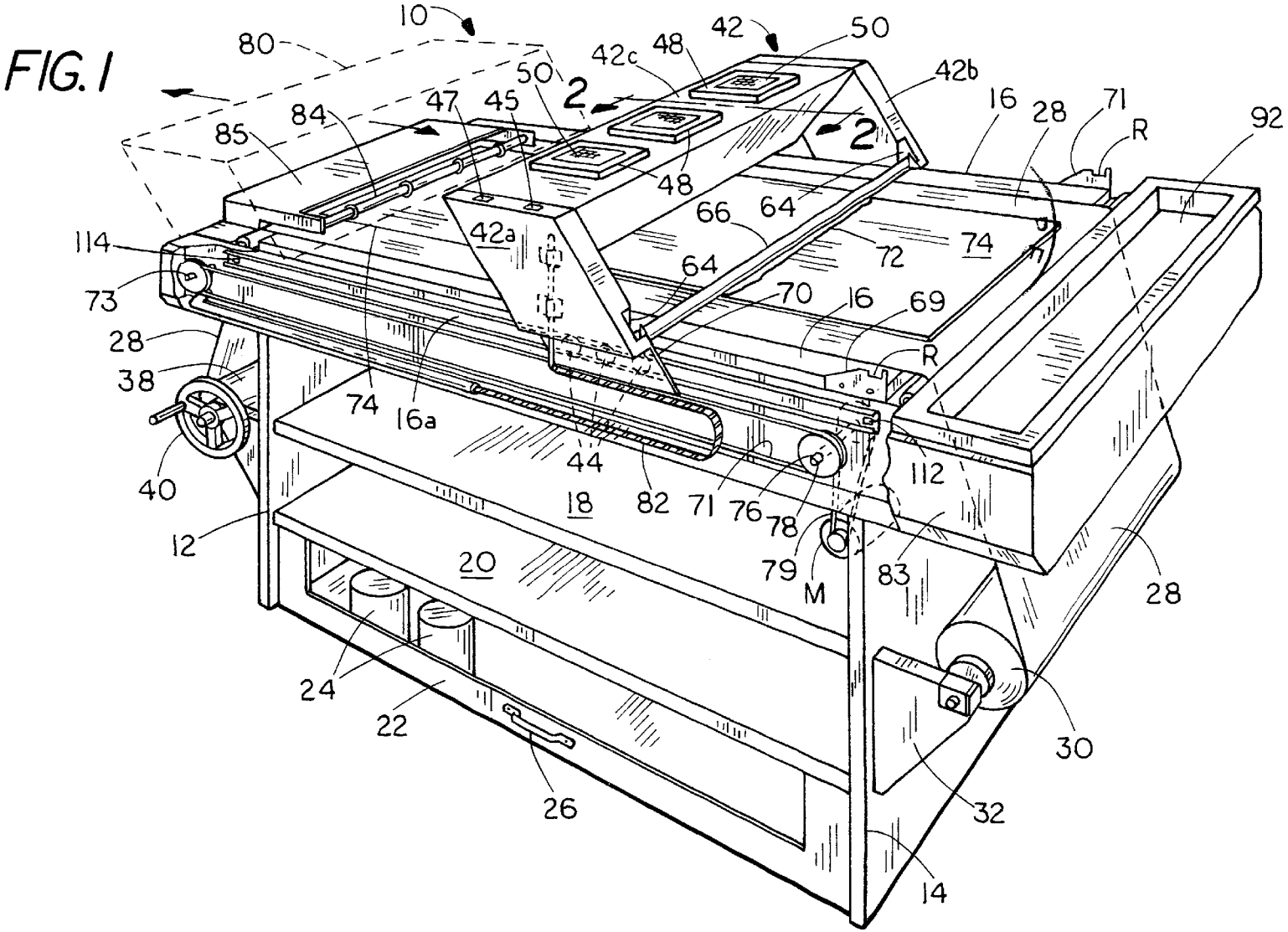
FIG. 1 is a front perspective view of a preferred form of the invention.

Refer now to the Figures and particularly to FIG. 1 which illustrates a coating apparatus 10 that includes a supporting framework composed of upright panels 12 and 14, a coating table 16 secured to the upper ends of the panels 12 and 14 to form a work surface, storage shelves 18 and 20 and a drawer 22 for storing cans of coating material 24 and other supplies. The drawer 22 is provided with a pull handle 26.

To provide a clean work surface by removing drippings and spills of coating materials, a strip of paper 28 is unwound from a supply roll 30 supported for rotation on an arbor 32 only part of which is shown, is carried upwardly over supporting rolls 34 and 36 at the ends of the table 16 and is collected on a roll 38 by turning a hand wheel 40 at the end of the arbor 39 upon which the roll 38 is wound. A fresh section of the protective paper strip 28 can be advanced into place on the coating table 16 to provide a clean work surface for each sheet that is to be coated.

On each side of the table 16 are identical tracks 16*a*. A carriage 42 is moveably supported on the tracks 16*a* at each end by means of idler wheels 44 mounted for rotation on a plate 70 at lower end of the carriage 42. The carriage 42 includes end panels 42*a* and 42*b* and a central dryer housing 42*c* that extends transversally across the coating table 16. The wheels 44 enable the carriage 42 to move towards the left or right across the coating table 16. The dryer housing 42*c* includes three electric fans 46 (FIG. 2) each supported in a vertically disposed inlet duct 48 and each having a removable air filter 50 at its upper end. During operation, the fans 46 draw air downwardly through the filter 50 into a plenum 52 within the dryer housing 42*c* having a top wall 54 and converging sidewalls 56 and 58 which are spaced apart from one another at their lower edges to define a transversally extending elongated jet nozzle 60 at the lower end of the dryer housing 42*c*. The jet nozzle 60 can be of any suitable size. Good results were obtained with a gap of about ¼ inch. Within the plenum 52 beneath the fans 46 is a transversely extending heater 62 of any suitable commercially available type such as an electrical resistance heater e.g., a Calrod heater or an electrical resistance heater wrapped around a tube of fused quartz. The heater 62 can be a 1,500-watt quartz heater about 38 inches in length. If the jet nozzle 60 is 0.25 inch in width and 38 inches in length, the jet of heated air can have a temperature of about 130° Fahrenheit. Good results have been obtained by placing the jet nozzle 60 about 1.5 inches above the sheet 74.

The end panels 42*a* and 42*b* provided with vertically disposed slots 64 to receive the ends of an applicator or gauge bar 66 which consists of a stainless steel rod 68 wrapped with stainless steel wire 66' appropriately sized to evenly distribute the emulsion 72 across the upper surface of any suitable backing sheet 74 such as a sheet of transparent plastic material which during the application process is placed on the horizontal work surface of coating table above the protective paper sheet 28. The sheet 74 is usually supplied with a protective cover which is removed just before the coating 72 is applied. While the sheet 74 can consist of a single sheet of transparent plastic, some users employ a laminate consisting of a receptor sheet as an upper layer and a base stock sheet consisting of plastisized paper as a lower layer. For simplicity of illustration the numeral 74 can refer either to a single sheet of plastic or a laminate. The rod 66 can be about ⅝ inch in diameter and is typically wrapped with 11 gauge stainless steel wire 66'. The fans 36 can be about six inches in diameter and each fan displaces about 100–150 cubic feet of air per minute.

Figure 9:
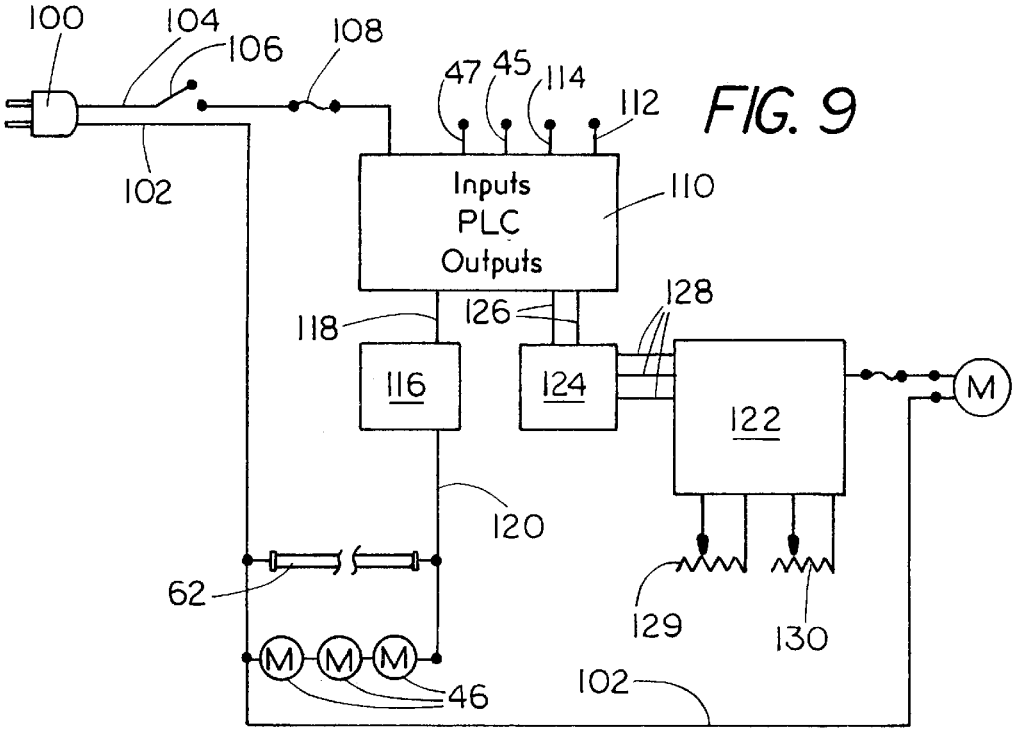
FIG. 9 is a diagrammatic electrical schematic in accordance with a preferred form of the invention.

As shown in FIG. 1 the lower edge of the plate 70 is connected to an endless chain or timing belt 71 which is entrained over a pair of sprockets 73 and 76. The sprocket 76 is affixed to a shaft 78 which is coupled with the drive chain and sprocket assembly 79 to a reversible drive motor M that is also shown in FIG. 9 for moving the carriage 42 either to the right or left during operation above a sheet 74 that is being coated. The motor M typically advances the carriage 42 at a coating speed of about three feet per minute and returns to its starting point at about one foot per minute. The carriage is initially located in the dotted line position 80 and is advanced toward the right in FIG. 1 to spread an emulsion 72 over the sheet 74. The photosensitive emulsion coating is usually less than one mil in thickness. Electrical power is supplied to the carriage 42 through a cable 82. The drive belt 72 and cable 82 can be enclosed in a housing 83 which has been broken away in FIG. 1 for clarity of illustration.

Figure 2:
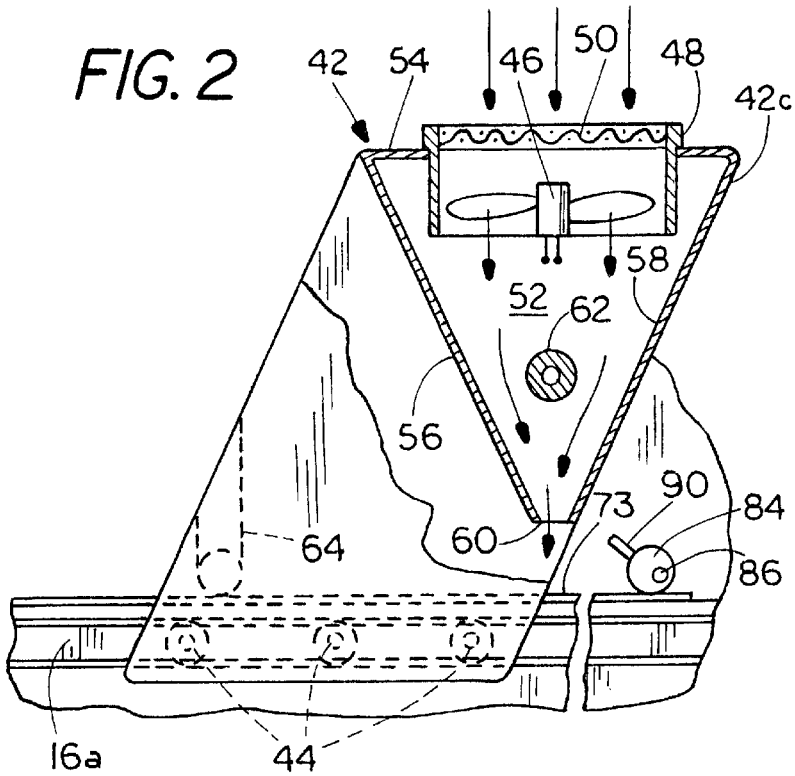
FIG. 2 is a transverse partial sectional view taken on Line 2—2 of FIG. 1 on an enlarged scale.
Figure 3:
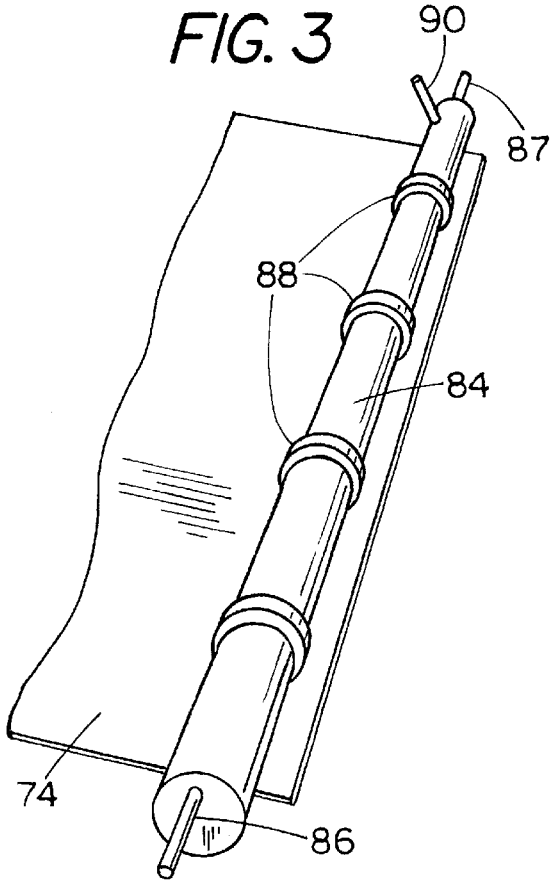
FIG. 3 is a perspective view of a preferred form of clamp for holding a sheet that is to be coated in a fixed position during the coating operation.

At the left end of the table 16 as seen in FIG. 1 is a clamp 84 for securely holding the sheet 74 in place on top of the table 16. The clamp 84 is supported on a fixed housing 85 by means of eccentrically located pivot pins 86 and 87. Mounted on clamp 84 are four rubber rings 88. To clamp the sheet in place the operator can pull upwardly on a lever 90 to pivot the clamp 84 into a locking position as shown in FIGS. 2, 3 and 6.

Figure 5:
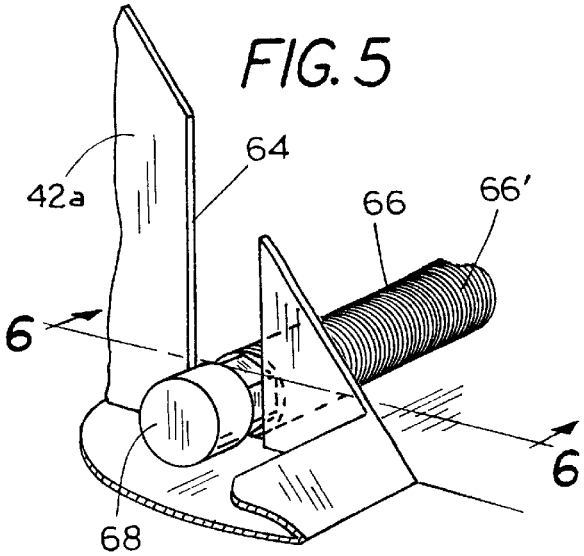
FIG. 5 is a partial perspective view of one end of the coating applicator and associated structure.
Figure 6:
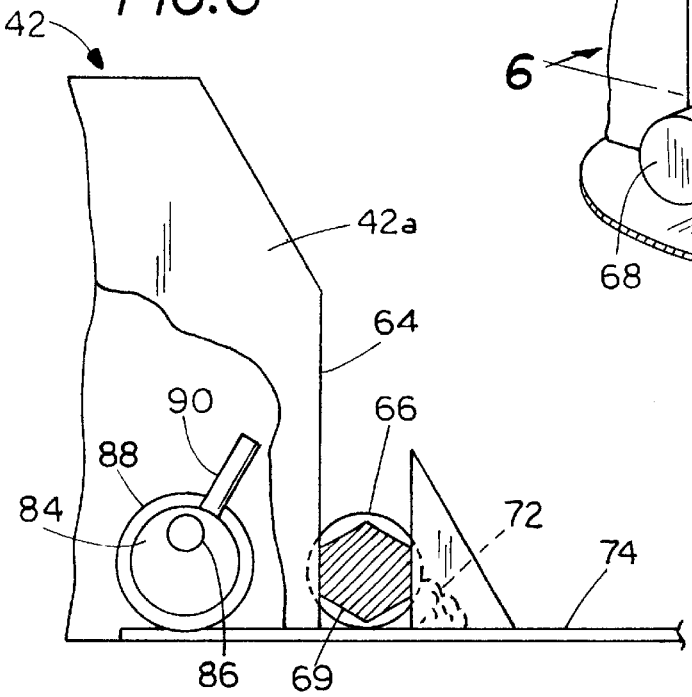
FIG. 6 is a vertical transverse sectional view taken on Line 6—6 of FIG. 5.
Figure 7:
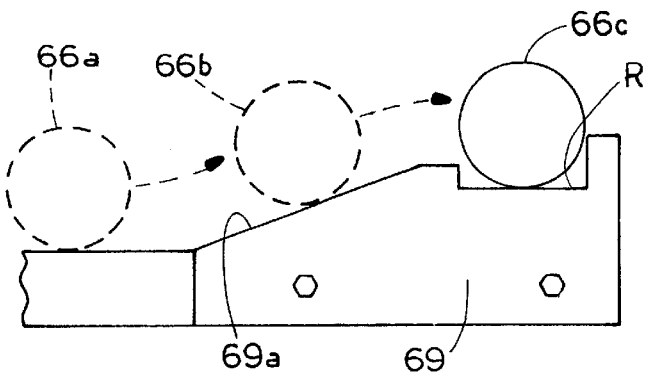
FIG. 7 is a diagrammatic side elevational view showing the automatic removal of the coating bar.
Figure 8:
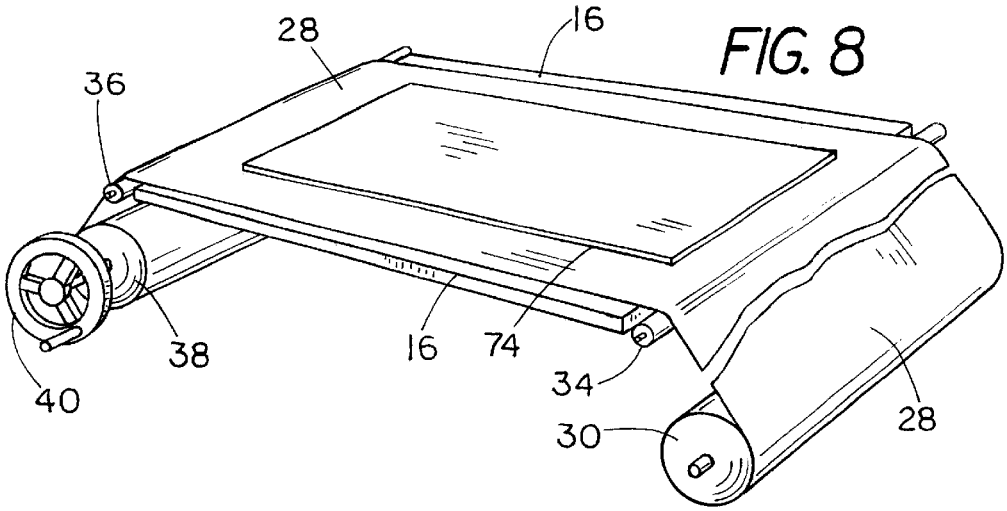
FIG. 8 is a diagrammatic perspective view showing the paper strip used for removing spilled coating material.

Refer now to FIGS. 5 and 6. It will be noted that the applicator rod 68 has a hexagonal cross section at each end 69 that is just the proper size to fit into the slots 64. In this way the applicator rod 66 is mounted loosely in the slots 64 and is able to slide vertically within them. At the right end of the table 16 are rigidly secured a pair of stationary unloading ramps 69 and 71 that are aligned with the ends of the coating rod 66. During operation, when the carriage 42 approaches the right end of the table in FIG. 1, the rod 66 is engaged at each end just inside the panels 41*a* and 42*b* by the unloading ramps as is shown in FIG. 7 so that the rod 66 is moved from its original elevation 66*a* (FIG. 7) upwardly along the inclined surface 69*a* of the ramp to position 66*b* and finally to a position 66*c* where the rod 66 rests in an upwardly opening recess R on the upper surface of each of the ramps 69 and 71. As this takes place, the rod is elevated all the way out of the slots 62 and 64 and is disconnected from the carriage 42. To control the direction of the motor M, forward and reverse switches are provided on the carriage at 45 and 47 respectively. When the coating has been applied, the motor M is reversed causing the carriage 42 to travel in the reverse direction to its original starting position 80 at the left end of the work table 16. The coating rod 66 which was withdrawn form the carriage remains in an exposed position in the recesses R on top of the unloading ramps 69 and 71 adjacent to an upwardly opening pan 92 that is partially filled with cleaning solution so that any emulsion 72 that clings to the rod 66 can be easily washed off by the operator by placing the rod in the cleaning solution within the pan 92. The rod can be washed while the carriage is moves back to its starting position 80. Once cleaned and dried the rod is ready for reuse.

Refer now to FIG. 9 which illustrates a preferred control circuit. Current is supplied by wall plug 100 through a conductor 102 and a conductor 104 which is connected to an on-off switch 106 and fuse 108 to a suitable programmable logic control (PLC) 110 that includes the following inputs: a forward switch terminal 45, a reverse switch terminal 47, a far limit switch terminal for switch 112 and a near limit switch terminal for switch 114 both of which are located on the ends of the machine as shown in FIG. 1. The PLC 110 is programmed so that when the limit switch 112 is engaged by the carriage 42, the motor M will be reversed and when the switch 114 is engage, the motor M will be turned off. The PLC 110 is connected to a fan and heat relay 116 by conductor 118 and the relay is connected to the motors 46 and heater 62 by conductor 120. PLC 110 is connected to a motor controller 128 and motor relay 124 by conductors 126 and 128. The speed of the motor M is controlled by potentiometers 129 and 130.

The operation will now be described. It is assumed that the carriage 42 is in the starting position at 80. A sheet of material such as a rectangular transparent plastic sheet 74 is placed on the table 16 above the protective paper strip 28 and secured in place by the clamp 84. The quantity of the emulsion 72 is then placed on the sheet 74 in front of the coating bar 66. If desired, the emulsion 72 can be spread manually from side to side so that it extends almost to the edges of the sheet 74. The operator then closes the forward switch 45 causing the motor M to drive the carriage 42 toward the right (FIG. 1) thereby spreading the emulsion 72 evenly over the surface of the sheet 74. When the end of the sheet 74 is reached, coating bar 66 will engage the unloading ramps 69 and 71 causing the bar 66 to be lifted out of the slots 64 and finally come to rest in the recess R in the upper surface of the ramps 69 and 71. The limit switch 112 will also be engaged causing the motor M to reverse thereby moving the carriage 42 in the reverse direction back to the starting position 80 whereupon the carriage will engage the limit switch 114 shutting off the motor M.

Figure 4:
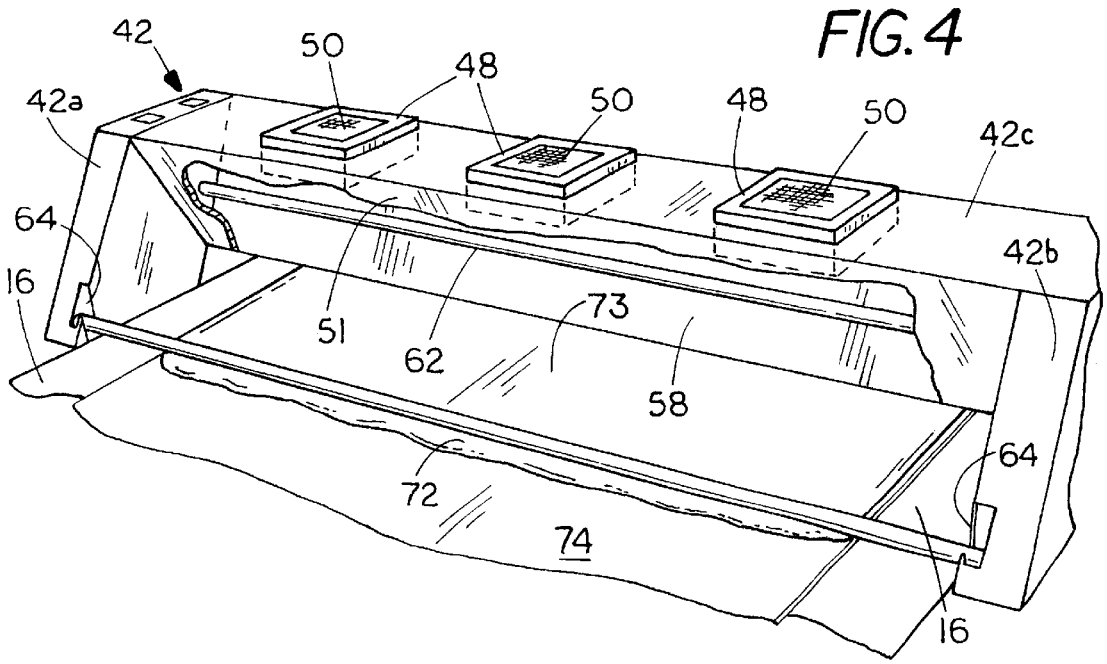
FIG. 4 is a rear perspective view of the coating carriage.

Optimally the jet 60 can, if desired, be directed down onto the freshly coated emulsion at 73 (FIG. 4) while the emulsion is still in a fluid state a short distance e.g., 3–6 inches behind the coating bar 66. The heater 62 can be used to heat the air to about 130° Fahrenheit where it leaves the nozzle 60 and impinges on the upper surface of the fresh emulsion coating at 73. After the carriage 42 reverses direction and begins its course of movement rearwardly to the starting position, the fans 46 and the heater 62 are most advantageously kept running to further dry the emulsion. By operating the device in this manner, drying time is reduced so that in only about four minutes the freshly applied coating 73 is hard enough so that the coating sheet 74 can be removed from the table 16 for further processing. The coating bar 66 which now is located in the recess R on the tops of the unloading ramps 69 and 71 can then be washed manually in the solution contained in the pan 92. After the coated sheet 74 is removed, the strip of protective paper 28 is advanced from the supply roll 30 across the top of the coating area and collected on the roll 38 by turning the hand wheel 40. For some applications, the heater and fans can be turned off when the motor M is reversed. For most applications, however, the heater and fans remain in operation during retrograde movement of the carriage 42 to the starting position 80.

It was found that the apparatus is able to apply very uniform photosensitive emulsion coatings to a plastic sheet 74 and that the coatings in addition to having a uniform thickness will have a smooth uniformly glossy surface. The apparatus is also able to dry the coating to sufficient hardness so that the coated sheet 74 can often be removed in less than five minutes after the coating has been applied and the carriage is returned to its starting position 80.

Many variations of the present invention within the scope of the appended claims will be apparent to those skilled in the art once the principles described herein are understood.

What is claimed is:

1. A coating apparatus suited for applying a photographic emulsion coating onto a backing sheet comprising, a framework having a table thereon for supporting a piece of flexible sheet material to be coated, a carriage mounted on the framework for rectilinear movement from a starting position along a path that is parallel to the surface of the sheet when the sheet is supported on the table, a coating applicator mounted upon the carriage for spreading the coating onto the backing sheet when the carriage is advanced across the framework along the rectilinear path parallel to the table, a coating dryer supported on the carriage to apply heat to the coating for drying freshly applied coating, a drive motor connected to the carriage for advancing the carriage across the table supporting the sheet that is being coated, the carriage being moveable in a reverse direction to the starting position whereby the coating can be applied by the applicator when the carriage moves in a first direction and the carriage is then able to move in the reverse direction to the starting position.

2. The apparatus of claim 1 including a movable protective paper strip on the table beneath the sheet being coated for removing drippings or spilled emulsion coating from a work area following a coating operation.

3. The apparatus of claim 1 including an upwardly opening pan adapted to contain a cleansing solution for washing the coating applicator.

4. The apparatus of claim 1 wherein the applicator comprises a coating rod having end portions mounted in slots at each end of the carriage, and said slots are normal to the surface of the table supporting the sheet material to enable the rod to be raised vertically to a position in spaced relationship above the sheet material that is being coated.

5. The apparatus of claim 4 wherein the apparatus includes a pair of unloading ramps aligned with the ends of the coating rod, said ramps each including an upwardly inclined ramp surface for engaging and raising the coating rod to said position.

6. The apparatus of claim 5 wherein the unloading ramps each have recesses in the upper surface thereof for supporting and retaining the coating rod after the rod has been removed from the carriage by the unloading ramps.

7. The apparatus of claim 1 wherein the dryer includes a heater and an air blower for directing a jet of heated air onto the freshly applied coating and for progressively applying heat to successive portions of the coated sheet.

8. The apparatus of claim 1 including a switch operatively connected to the motor for reversing the motor when the sheet has been coated and for thereby reversing the direction of the carriage to return the carriage to the starting position while the coating dryer dries the applied coating.

9. A coating apparatus suited for applying a photographic emulsion coating on a backing sheet comprising, a framework having a table thereon for supporting a piece of flexible sheet material to be coated, a carriage mounted on the framework for rectilinear movement from a starting position along a path that is parallel to the surface of the sheet when the sheet is supported on the table, a coating applicator disconnectably mounted upon the carriage for spreading the coating onto the sheet material when the carriage is advanced in a first direction across the framework along the rectilinear path parallel to the table, a coating dryer supported on the apparatus to apply heat to the coating for drying applied coating material, a drive unit connected to the carriage for advancing the carriage across the table supporting the sheet that is being coated, the carriage being moveable in a reverse direction to the starting position whereby the coating can be applied by the applicator when the carriage moves in the first direction and the carriage is then able to be moved in said reverse direction to the starting position.

10. The apparatus of claim 9 including a protective strip of material on the table beneath the sheet being coated for catching and removing drippings or spilled coating material from a work area following a coating operation.

11. The apparatus of claim 9 including an upwardly opening pan adapted to contain a cleansing solution for washing the coating applicator.

12. The apparatus of claim 9 wherein the applicator comprises a coating rod having end portions mounted for movement away from the table at each end of the carriage to enable the rod to move into spaced relationship above the sheet material that is being coated and an unloading member for engaging and disconnecting the rod from the carriage.

13. An apparatus for applying and drying an emulsion coating on the surface of a flexible sheet of material, said apparatus comprising, a supporting framework having a worktable for supporting a sheet of said sheet of material to be coated, a carriage moveably mounted on the framework, said carriage having an applicator thereon for spreading the coating onto the surface of the sheet of material supported on the framework and a heater on the carriage proximate to the applicator for progressively heating successive portions of the coating after the coating has been applied to thereby dry the coating.

14. The apparatus of claim 13 wherein the carriage is reversible such that the carriage moves in a first direction for applying the coating and in a reverse direction for enabling the heater to apply heat to the coating as the carriage moves in said reverse direction to a starting point.

15. The apparatus of claim 13 wherein the applicator comprises a spreader rod, the spreader rod is disconnectably supported upon the carriage and said apparatus includes means for removing spreader rod from the carriage after the coating has been applied such that the carriage is able to return to a starting point without the spreader bar supported thereon.

16. The apparatus of claim 13 wherein the heater comprises a heating element and a blower is associated therewith for blowing air over the heating element onto the applied coating to dry the coating.

17. The apparatus of claim 13 wherein the heater is contained within a plenum and a jet nozzle is provided in spaced relation to the work table through which a jet of air from the plenum is directed onto successive portions of the applied coating as the carriage is moved thereacross.

18. The apparatus of claim 13 wherein a strip of protective sheet material is supported on the framework beneath the sheet of material that is to be coated and an arbor is provided for winding up the strip of protective sheet material to remove any of the coating that may have spilled onto the worktable.

* * * * *